US011821147B2

(12) United States Patent
Kopf et al.

(10) Patent No.: US 11,821,147 B2
(45) Date of Patent: Nov. 21, 2023

(54) METHOD AND DEVICE FOR COMPACTION OF A TRACK BALLAST BED

(71) Applicant: PLASSER & THEURER EXPORT VON BAHNBAUMASCHINEN GMBH, Vienna (AT)

(72) Inventors: Fritz Kopf, Vienna (AT); Dietmar Adam, Moedling (AT); Bernhard Antony, Stockerau (AT); Florian Auer, Vienna (AT); Olja Barbir, Vienna (AT); Johannes Pistrol, Vienna (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 558 days.

(21) Appl. No.: 16/617,680

(22) PCT Filed: May 2, 2018

(86) PCT No.: PCT/EP2018/061092
§ 371 (c)(1),
(2) Date: Nov. 27, 2019

(87) PCT Pub. No.: WO2018/219570
PCT Pub. Date: Dec. 6, 2018

(65) Prior Publication Data

US 2020/0181850 A1 Jun. 11, 2020

(30) Foreign Application Priority Data

May 29, 2017 (AT) ..... A 223/2017

(51) Int. Cl.
*E01B 27/17* (2006.01)
*E01B 35/08* (2006.01)
(Continued)

(52) U.S. Cl.
CPC ..... *E01B 27/17* (2013.01); *E01B 27/16* (2013.01); *E01B 35/08* (2013.01); *E01B 35/00* (2013.01);
(Continued)

(58) Field of Classification Search
CPC ..... E01B 27/16; E01B 27/17; E01B 27/20; E01B 35/00; E01B 35/02; E01B 35/04;
(Continued)

(56) References Cited

U.S. PATENT DOCUMENTS 3,981,247 A 9/1976 Theurer
4,240,352 A 12/1980 Theurer
(Continued)

FOREIGN PATENT DOCUMENTS

AT 339358 B 10/1977
AT 350097 B 5/1979
(Continued)

*Primary Examiner* — Zachary L Kuhfuss
*Assistant Examiner* — Cheng Lin
(74) *Attorney, Agent, or Firm* — Laurence A. Greenberg; Werner H. Stemer; Ralph E. Locher

(57) ABSTRACT

A method for compaction of a track ballast bed uses a tamping unit including two oppositely positioned tamping tools which are actuated with vibrations and are lowered into the track ballast bed during a tamping operation and moved towards one another with a squeezing motion. A progression of a force acting upon the tamping tool over a path covered by the tamping tool is recorded during a vibration cycle by sensors disposed at the tamping unit for at least one tamping tool. At least one characteristic value is derived therefrom and used to carry out an evaluation of the tamping operation and/or of a quality of the track ballast bed. The tamping unit is thus used as a measuring apparatus during operative use. A device for performing the method is also provided.

15 Claims, 6 Drawing Sheets

(51) Int. Cl.
*E01B 27/16* (2006.01)
*E01B 35/00* (2006.01)

(52) U.S. Cl.
CPC ..... *E01B 2203/10* (2013.01); *E01B 2203/12* (2013.01); *E01B 2203/127* (2013.01)

(58) Field of Classification Search
CPC ..... E01B 35/06; E01B 35/08; E01B 35/10; E01B 35/12; E01B 2203/10; E01B 2203/12; E01B 2203/122; E01B 2203/127
See application file for complete search history.

(56) References Cited

U.S. PATENT DOCUMENTS

| | | | | |
|---|---|---|---|---|
| 9,957,668 | B2 * | 5/2018 | Lichtberger | E01B 27/16 |
| 10,036,128 | B2 * | 7/2018 | Salciccia | E01B 27/16 |
| 10,808,362 | B2 * | 10/2020 | Seyrlehner | B06B 1/164 |
| 2019/0055698 | A1 * | 2/2019 | Hofstaetter | E01B 27/13 |
| 2019/0137356 | A1 * | 5/2019 | Philipp | G01M 13/00 |

FOREIGN PATENT DOCUMENTS

| | | | | | |
|---|---|---|---|---|---|
| AT | 515801 | A4 | | 12/2015 | |
| AT | 515801 | B1 | * | 12/2015 | E01B 27/16 |
| CN | 201933369 | U | | 8/2011 | |
| CN | 105189868 | A | | 12/2015 | |
| CN | 108603345 | A | | 9/2018 | |
| CN | 109196327 | A | | 1/2019 | |
| EP | 2770108 | A1 | | 8/2014 | |
| FR | 2532967 | A1 | * | 3/1984 | E01B 27/16 |
| WO | 2017129215 | A1 | | 8/2017 | |
| WO | 2017202484 | A1 | | 11/2017 | |

* cited by examiner

METHOD AND DEVICE FOR COMPACTION OF A TRACK BALLAST BED

BACKGROUND OF THE INVENTION

Field of the Invention

The invention relates to a method for compaction of a track ballast bed by means of a tamping unit comprising two oppositely positioned tamping tools which, actuated with vibrations, are lowered into the track ballast bed in the course of a tamping operation and moved towards one another with a squeezing motion. Additionally, the invention relates to a device for performing the method.

Description of the Related Art

Railway tracks with ballasted permanent way require regular correction of the track position, for which generally track tamping machines or switch tamping- or universal tamping machines are used. Such machines, mobile on the track in a cyclic or continuous manner, usually comprise a measuring system, a lifting- /lining unit and a tamping unit. By means of the lifting- /lining unit, the track is lifted into a prescribed position. In order to fix said new position, track ballast is tamped from both sides under a respective sleeper of the track and compacted by means of tamping tools situated on the tamping unit.

Depending on the condition of the track ballast (new position, start of useful life, end of useful life) or the degree of deterioration, a corresponding over-correction of the track position is appropriate so that, as a result of subsequent settlement, the track assumes the desired final position. In this, the settlement may take place through stabilization by means of a Dynamic Track Stabilizer and, in any case, by the subsequent regular stress by the train traffic.

Various structural designs are known in tamping units for tamping sleepers of a track. AT 350 097 B, for example, discloses a tamping unit wherein, for transmission of vibrations, hydraulic squeezing drives are articulatedly connected to a rotating eccentric shaft. Known from AT 339 358 B is a tamping unit having hydraulic drives which serve as squeezing drives and as vibration generators in a combined function.

AT 515 801 A4 describes a method for compacting a track ballast bed by means of a tamping unit, wherein a quality figure for a ballast bed firmness is to be identified. To that end, a squeezing force of a squeezing cylinder in dependence of a squeezing path is recorded, and via an energy consumption derived therefrom, a characteristic figure is defined. However, this characteristic figure is of little significance since a considerable energy portion lost in the system is not taken into account. Furthermore, even the total energy actually introduced into the ballast during a tamping operation would not allow a reliable assessment of a ballast bed condition.

SUMMARY IF THE INVENTION

It is the object of the invention to provide an improvement over the prior art for a method and a device of the kind mentioned at the beginning.

According to the invention, this object is achieved by way of a method for compaction of a track ballast bed by using a tamping unit including two oppositely positioned tamping tools which, actuated with vibrations, are lowered into the track ballast bed during a tamping operation and moved towards one another with a squeezing motion and a device for performing the method including a tamping unit including two oppositely positioned tamping tools which are coupled in each case via a pivot arm to a squeezing drive and a vibration drive. Dependent claims indicate advantageous embodiments of the invention.

The method is characterized in that, for at least one tamping tool, a progression of a force acting upon the tamping tool over a path covered by the tamping tool is recorded during a vibration cycle by means of sensors arranged at the tamping unit, and that from this at least one characteristic value is derived by means of which an evaluation of the tamping operation and/or of a quality of the track ballast bed is carried out. In this manner, the tamping unit is used during operative use as a measuring apparatus in order to record a force-path progression (work diagram) of the tamping tool and to derive from this a meaningful characteristic value.

Specifically, the work process of compacting serves as a measuring procedure in order to determine on-site the load-deformation behaviour of the track ballast and the changes thereof. By analysis of the measurement values in real time and the formation of at least one characteristic value, the track ballast quality and -compaction can already be assessed on-line during the compaction process. In further sequence, process parameters of the compaction and of the corrected track position can be continually adjusted accordingly. For example, a target value for an over-correction of the track position can be derived from the evaluation of the ballast bed quality.

In addition, it is advantageous if the characteristic value is prescribed as a parameter for controlling the tamping unit. The automatized adjustment of the tamping operation thus achieved allows a quick reaction to a changing condition of the ballast bed. For example, several squeezing operations can automatically take place until a prescribed degree of ballast compaction is attained.

An advantageous embodiment of the invention provides that, for evaluation of a ballast condition or a compaction condition of the ballast bed, a maximal force acting on the tamping tool during the vibration cycle is derived as a first characteristic value. This first characteristic value takes into account that the track ballast can resist the tamping tool with only a limited force (reaction force). The maximal force depends, on the one hand, on which phase of the tamping operation the examined vibration cycle is in, and, on the other hand, on the ballast condition. Thus, the first characteristic value is a meaningful indicator of both the ballast condition (new ballast offers higher resistance) and also of the compaction quality (increase in the course of the compaction).

In a useful further development, for evaluation of a compaction condition of the ballast bed, a vibration amplitude occurring during the vibration cycle is derived from the recorded force-path progression as a second characteristic value. For defining the amplitude, reversing points of the dynamic movement of the tamping tools can be determined in absolute coordinates and/or relative coordiantes (dynamic oscillation path). During this, it is taken into account that, due to design, both the squeezing motion as well as the dynamic tamping tool motion are not purely path-controlled.

Additionally it is advantageous if, for evaluation of a ballast condition of the ballast bed, a start of contact between tamping tool and ballast and a loss of contact between tamping tool and ballast is determined for the vibration cycle, and that from this a third characteristic value is derived. In a squeezing phase, there is a pronounced asymmetrical stressing of the tamping tool, wherein the squeezing motion results in a direction of treatment of the ballast in the direction towards the sleeper to be tamped. In this, the position of a point of start of contact and the position of a point of loss of contact depend on the ballast condition. Therefore, a section with contact and a section without contact in the force-path-progression are good indicators for the track ballast quality.

A further advantageous evaluation of the force-path-progression provides that, as a fourth characteristic value, an inclination of the progression during a stress phase of the tamping tool is derived. As stress stiffness, this inclination of the work line in the stress branch of the work diagram gives information about the load bearing capacity of the track ballast. It increases in the course of ballast compaction and is used as proof of compaction.

Advantageously, for evaluation of the ballast condition, an inclination of the progression during a relief phase of the tamping tool is also derived as a fifth characteristic value. In this, said inclination of the work line in the relief branch of the work diagram is to be seen as relief stiffness. During relief, new ballast partly shows elastic behaviour and springs back with the tamping tool during the rearward motion of the same up to the loss of contact. Old ballast, on the contrary, hardly reacts elastically. Therefore, the relief stiffness is a good indicator for the ballast condition.

For determining a utilization degree, it is advantageous if a deformation work performed by means of the tamping tool is derived from the recorded progression as a sixth characteristic value. This deformation work corresponds to the area enclosed by the work line. It is that part of the work of the drive of the tamping unit which is transmitted into the track ballast in order to effect a compaction, a displacement, a flowing of the ballast etc. With this sixth characteristic value, it is possible in a simple manner to optimize the efficiency of the track tamping.

A futher improvement provides that, for determining an overall stiffness of the ballast bed, an overall inclination of the progression is derived as a seventh characteristic value. In a phase of penetration into the track ballast, the tamping tool acts in both directions since, as a result of the lack of a squeezing motion, it introduces dynamic forces into the ground also at its rear side. Due to the double-sided mode of action, the physical sense of the stress- and relief stiffness becomes obsolete, and the overall stiffness is represented by the inclination of the work line.

In this, it is favourable if the overall inclination is determined by linear regression of the recorded progression, for example with the method of the least error squares.

In a further development of the method according to the invention, the progression of the force acting on the tamping tool over the path covered by the tamping tool is recorded for several vibration cycles of a tamping operation, wherein a figure per characteristic value is determined for each of these vibration cycles, and wherein an evaluation procedure takes place by means of a progression of these found characteristic values or by means of several characteristic value progressions. Depending on the characteristic value used, it is possible in a simple manner to draw conclusions from the characteristic value progression about the ballast condition and/or the state of compaction.

It is additionally advantageous if several squeezing operations are performed at a track location, wherein for each characteristic value a figure for a vibration cycle or for each characteristic value a characteristic value progression for several vibration cycles is determined for each squeezing operation for evaluation of a compaction condition of the ballast bed, and wherein in the event of non-attainment of a prescribed compaction condition, a further squeezing operation is performed. In this, the characteristic values or characteristic value progressions show distinct differences between the successive squeezing operations.

An additional further development of the method provides that a characteristic value for a vibration cycle or a characteristic value progression for several vibration cycles is determined in each case for several tamping operations at different locations along a track, and that from this an evaluation of a spatial development of a compaction result and/or the quality of the ballast bed takes place. This superordinate progression of the characteristic values across several tamping operations reveals information about the homogeneity of the track, the ballast condition and the compaction result.

The device, according to the invention, for device for performing one of the afore-mentioned methods includes a tamping unit comprising two oppositely positioned tamping tools which are coupled in each case via a pivot arm to a squeezing drive and a vibration drive, wherein sensors for recording the progression of the force acting on the tamping tool over the path covered by the tamping tool are arranged at at least one pivot arm and/or the associated tamping tool, wherein measuring signals of the sensors are fed to an evaluation device, and wherein the evaluation device is designed for determining a characteristic value derived from the progression.

In this, it is advantageous if at least one force-measuring sensor is arranged in a tamping tool mount. The force-measuring sensor is thus protected from interfering influences and measures with high precision the forces acting on the tamping tool. During this, a flexing of the tamping tool is compensated in a simple manner. Additionally, acceleration sensors or position sensors are arranged for recording the path of the tamping tool.

BRIEF DESCRIPTION OF THE SEVERAL VIEWS OF THE DRAWINGS

The invention will be described below by way of example with reference to the accompanying drawings. There is shown in a schematic manner in.

DESCRIPTION OF THE INVENTION

Figure 1:
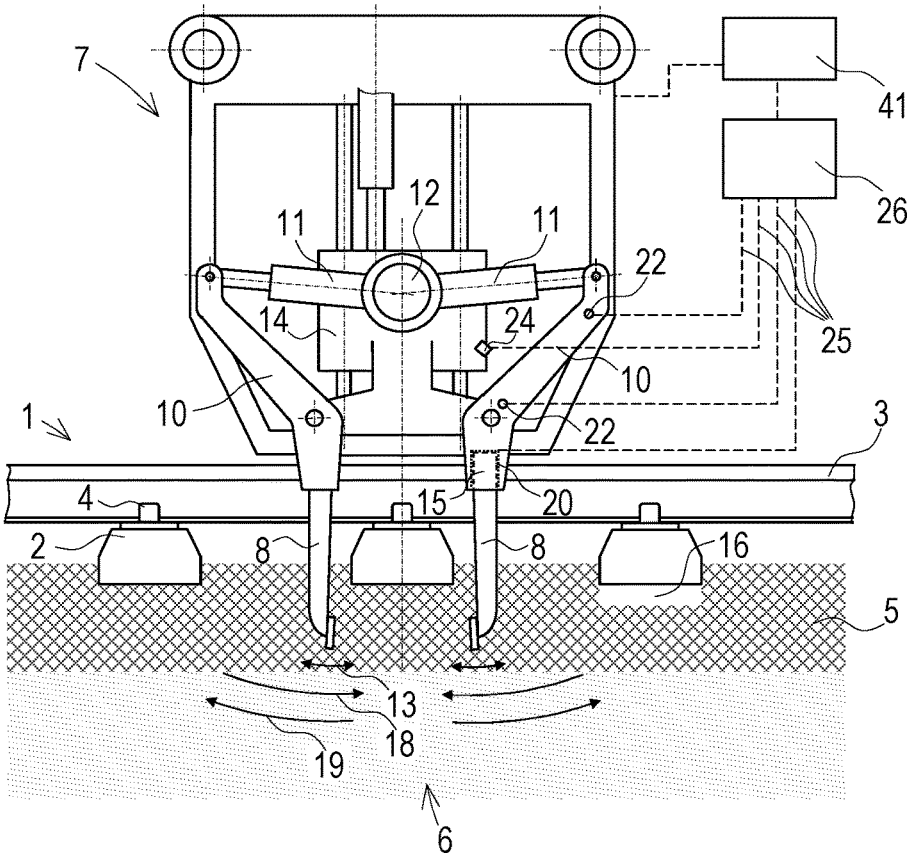
FIG. 1 a tamping unit

FIG. 1 shows a track 1 including a track panel which consists of sleepers 2, rails 3 and fastening means 4 and rests on a ballast bed 5. A tamping unit 7 is positioned at a location 6, to be worked on, of the track 1. Said tamping unit 7 comprises two oppositely positioned tamping tools 8 (tamping tines) which, during a tamping operation 9, enclose the sleeper 2 to be tamped. Usually in this, four pairs of pivot arms, each having two pairs of tamping tools, are arranged along a sleeper 2.

Each tamping tool is coupled via a pivot arm 10 to a squeezing drive 11 and a vibration drive 12. Vibrations 13 are produced, for example, by means of a rotating eccentric shaft. An eccentric shaft housing including a rotation drive is mounted on a lowerable tool carrier 14 to which the two pivot arms 10 are also articulatedly connected. Alternatively, a vibration drive 12 can be arranged also at the respective articulated connection. In the case of such an arrangement—not shown—the tamping tools 8 move along elliptic paths.

Each pivot arm 10 acts as a two-arm lever, wherein the associated tamping tool 8 is fastened at a lower lever arm in a tamping tool mount 15. An upper lever arm is coupled to the vibration drive 12 via the squeezing drive 11 designed as a hydraulic cylinder.

When tamping the track 1, the track panel is first lifted, causing the formation of cavities 16 under the sleepers 2. The tamping unit 7 is positioned above a sleeper 2 at the location 6 to be worked on, and the tamping tools 8 are actuated with the vibrations 13 by means of the vibration drive 12. Specifically, the generated vibrations 13 cause a rapid opening and closing of the tamping tools 8, movable in a pincer-like fashion, with a small amplitude (vibration). In this, there is no contact yet with ballast 17.

The actual tamping operation 9 is divided into several phases. In a first phase, the tool carrier 14 with the tamping tools 8 is lowered into sleeper cribs situated adjacent to the sleeper 2. The respective tamping tool 8 penetrates vertically into the ballast bed 5, wherein the vibrations 13 or dynamic motions facilitate a displacing of the ballast 17.

In a second phase during the lowering, a squeezing motion 18 already starts and the respective tamping tool 8 moves towards the sleeper 2. The lowering ends at a defined penetration depth, and the squeezing motion 18 is continued. In the course of the squeezing motion 18, ballast 17 is tamped by means of the tamping tools 8 under the sleeper 2, then compacted and possibly displaced laterally. During this, the vibrations 13 (vibration with approximately 35 Hz) continue to be superimposed on the squeezing motion 18 which mainly serves for ballast transport. With this dynamic compaction of the ballast 17, a so-called ballast flow can also be induced.

Before the particular tamping tool 8 touches the the sleeper 2, a motion reversal takes place in a third phase. The tool carrier 14 including the tamping tool 8 is moved upward, and a return motion 19 (reverse squeezing motion) causes an opening of the tamping tools 8 positioned oppositely in a pincer-like fashion.

Figure 2:
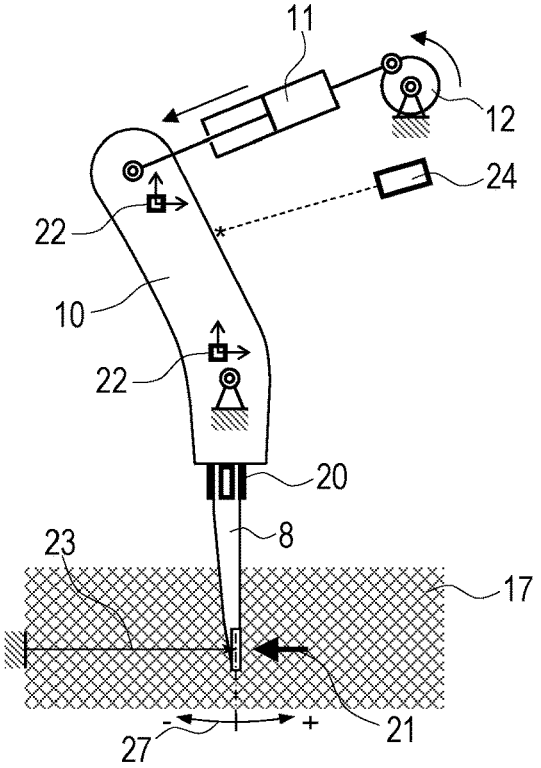
FIG. 2 a tamping unit and pivot arm with sensors

A force measuring sensor 20 is arranged in the tamping tool mount 15. Alternatively, sensors (strain gauges) may also be arranged on a shaft of a tamping tool 8 provided for the measurements. With this, a horizontal contact force 21 to the ballast 17 is recorded (FIG. 2). In addition, the pivot arms 10 are equipped with acceleration sensors 22 (depending on the type of machine, one or two acceleration sensors 22 per pivot arm 10 are used). An absolute squeezing path 23 is measured by means of a displacement measuring sensor 24 (for example, a laser sensor). Track tamping machines often have several tamping units 7. Then, each of these units 7 is advantageously equipped with the sensors 20, 22, 24.

Measuring signals 25 recorded by means of the sensors 20, 22, 24 are fed to an evaluation device 26. This evaluation device 26 is designed for processing the measuring signals 25 in order to record a force, acting on the tamping tool 8 in question, over a path covered by the tamping tool. Specifically in this, the horizontal contact force 21 is determined via a vibration path 27 as a force-path progression 28 (work diagram).

In order to determine the dynamic vibration path 27, first the vibration paths of the acceleration sensors 22 are found by double integration of the acceleration signals. Via the known geometric relationships, the vibration path 27 at the free end of the tamping tool (tine plate) is determined.

By way of the force measurement at the shaft of the tamping tooL 8, cutting forces (moments, normal force, transverse force) are determined. From this, the evaluation device 26 computes the horizontal contact force 21. This contact force 21 corresponds to the reaction force of the ballast 17 to the displacement forced upon it. A flexing of the tamping tool 8 can be compensated in a simple manner with the measured force. In addition, by means of the determined tamping tool movements, a compensation of the mass inertia force of the tamping tool 8 takes place.

The result of these sensor signal evaluations is the force-path progression 28 for the individual vibration cycles 29 of a squeezing operation. In further sequence, this relation between the tamping tool movement and contact force 21 is used for evaluation of the compaction procedure and of the condition of the ballast 17 or the ballast bed 5.

Figure 3:
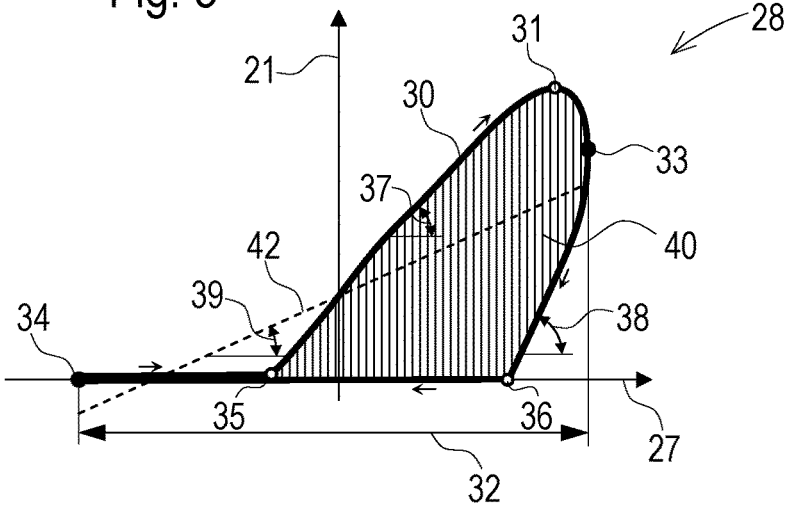
FIG. 3 a force-path progression (work diagram) with new ballast
Figure 4:
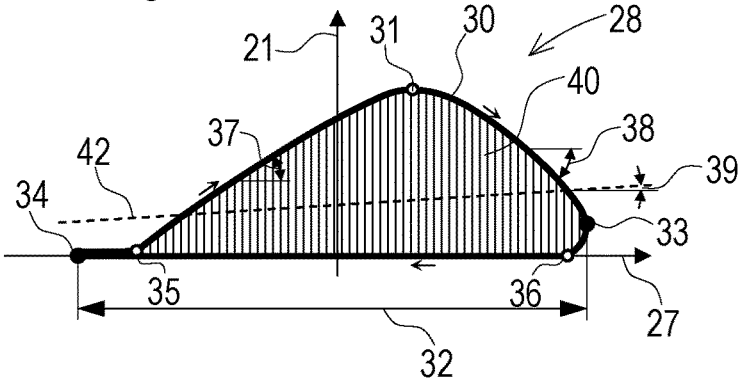
FIG. 4 a force-path progression with old ballast
Figure 5:
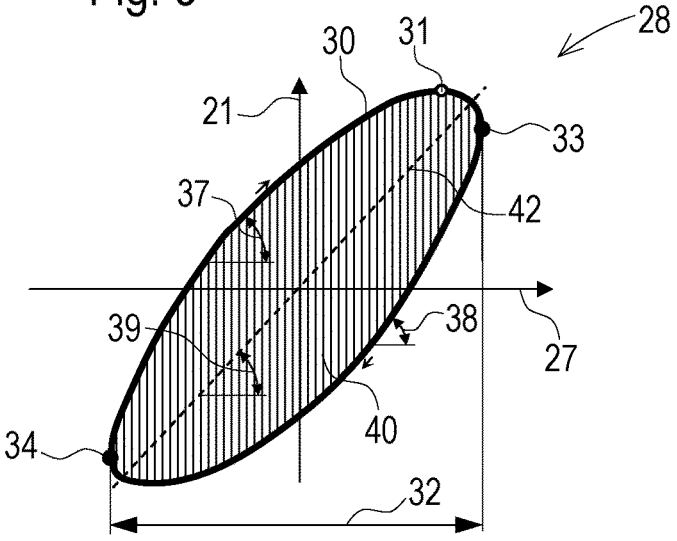
FIG. 5 a force-path progression when penetrating into the ballast

Examples of force-path progressions 28 for an vibration cycle 29 are shown in FIGS. 3-5. In this, the vibration path 27 is indicated on an abscissa, and the the contact force 21 on an ordinate. The force-path progression 28 itself is represented in the shape of a work line 30. These work diagrams have distinguishing features which allow a clear conclusion as to the conditions prevalent during the measurement. In particular, it is possible to draw conclusions as to the particular work phase (lowering, squeezing or returning), the degree of compaction and the ballast condition (new, freshly broken ballast or old, soiled, rounded ballast). FIG. 3 shows a work diagram for new ballast having sharp edges and a high degree of interlocking. FIG. 4 shows a work diagram for old ballast having rounded edges, little interlocking, high compaction and a high fines content. The distinguishing features (characteristic values) of the work diagrams allow an automatized grouping into condition categories, such as new ballast, ballast with little useful life, and ballast with advanced or ending useful life.

The distinguishing features usable as characteristic values are a maximal force 31, a vibration amplitude 32, a front turning point 33, a rear turning point 34, a contact starting point 35, a contact loss point 36, an inclination 37 of the work line 30 during a stress phase (stress stiffness), an inclination 38 of the work line 30 during a relief phase (relief stiffness), an overall inclination 39 of the work line, and a peformed deformation work 40 as an area enclosed by the work line 30. For determining these characteristic values 31-40, it is also possible to use the absolute squeezing paths 23 instead of the relative vibration paths 27.

The work-integrated measuring and characteristic-value determination and the evaluation of the ballast condition based thereon allow a continuous quality control and the optimization of the process parameters of the tamping operation 9. The condition of the track ballast 17 can be assessed on the basis of the two extremes, the new ballast from a quarry and the old ballast at the end of its technical useful life. Depending on ballast quality, stress, environmental influences and subgrade circumstances, the ballast condition goes through all intermediate stages, wherein a ballast reconditioning or a mixing of ballast can also take place in the course of maintenance measures. In particular, it is possible to state that new ballast 17 is clean, has sharp edges and a defined grain size distribution. Old ballast 17, on the contrary, is soiled, has rounded edges and an altered grain size distribution as a result of contamination, abrasion, grain disintegration and fines from the subgrade.

In addition, the work-integrated determination of the ballast stiffness and the assessment of the compaction condition based thereon allow a continuous quality control and the optimization of the process parameters of the tamping operation 9. The condition of the track ballast 17 can be assessed on the basis of specific ballast characteristics. Loosely poured ballast is loosely packed and has great pore volume as well as low bearing capacity. During loading stress there are relatively great deformations which are for the most part irreversible. The stiffness of such uncompacted ballast is low. Compacted ballast, on the other hand, is tightly packed and has small pore volume. As a result of the compaction, deformations are largely pre-empted, which is why only small deformations occur any more under load. These are mostly elastic, i.e. reversible. Compacted ballast has high stiffness.

The defined characteristic values 31-40 of a vibration cycle 29 characterize the tamping operation 9 in such a way that it is possible in a simple manner to make statements about the track ballast condition and the compaction process. To that end, the characteristic values 31-40 or the work diagrams are either shown in a display device or compared to a pre-defined evaluation scheme. Individual characteristic values 31-40 can be prescribed as parameters for controlling the tamping unit 7. To that end, data are transmited from the evaluation device 26 to a machine control 41.

In the following exemplary description of the correlations, the force-path progressions 28 are interpretated in a simplifying manner. For better clarity, existing cross-relations are not touched upon. Rather, links of characteristic values 31-40 and assessable mechanisms with the most obvious correlations are emphasized.

The maximal force 31 is a good indicator of both the ballast condition as well as the compaction condition. The vibration amplitude 32 is defined by the turning points 33, 34 of the dynamic tamping tool motion. The rising resistance of the ballast 17 is accompanied by a slight reduction of the vibration amplitude 32, which is why this second characteristic value is a good indicator of the compaction condition.

In the force-path progression 28, the contact starting point 35 and the contact loss point 36 separate a section of force-locking contact between tamping tool 8 and ballast 17 from a section without contact. In the work diagram it can be seen that the tamping tool 8 strikes the ballast 17 in a forward motion, the contact force 21 rises to the maximum 31 and then decreases again because the tamping tool 8 has reached the front turning point 33 and starts to move backward again. In this backward motion, it loses contact with the ballast 17 pressed in the working direction and carries out the remaining backward motion with a negligible force effect. Only after the change of direction at the rear turning point 34 does the tamping tool 8 move in the working direction again in order to come into contact with the track ballast anew. FIGS. 3 and 4 clearly show that the positions of the contact points 35, 36 depend on the ballast condition. Therefore, the positions of the line of contact and the line of contact loss can be used as indicators of the ballast quality.

The stress stiffness of the track ballast 17 is the relationship between force and associated deformation. In the force-path progression 28, it is represented as the inclination of the work line 30 in a stress branch. The stress stiffness is an essential characteristic value for assessing the bearing capacity of the track ballast. It rises in the course of ballast compaction and is used as proof of compaction.

The relief stiffness is represented as inclination of the work line 30 in a relief phase. In FIG. 4, the contact force 21 decreases already before reaching the turning point 34 as a result of the reduction of the speed of deformation, even though the deformation still increases. As a result of this inelastic behaviour, old track ballast 17 has low and often even negative relief stiffness. Thus, the relief stiffness is suitable as an indicator of the ballast condition.

The area enclosed by the work line 30 corresponds to the deformation work 40 performed. With the relative vibration path $x_{rel}$, the contact force F and a vibration cycle duration T, the deformation work W is calculated with the following formula:

$$W = \oint_T F \cdot dx_{rel}$$

The efficiency of the track tamping can be optimized with this characteristic value in that the tamping unit 7 is operated in such a manner that the deformation work 40 is at a maximum.

FIG. 5 shows a work diagram in the phase of penetration in which the tamping tool 8 acts approximately symmetrically in both directions. In this, the work line 30 resembles an oval. The resistance of the ballast 17 can be described by the stiffness which is represented as an inclination of said oval. Specifically, the overall inclination 39 is represented as inclination of a line 42 which is determined by linear regression after the method of the least square error.

Figure 6:
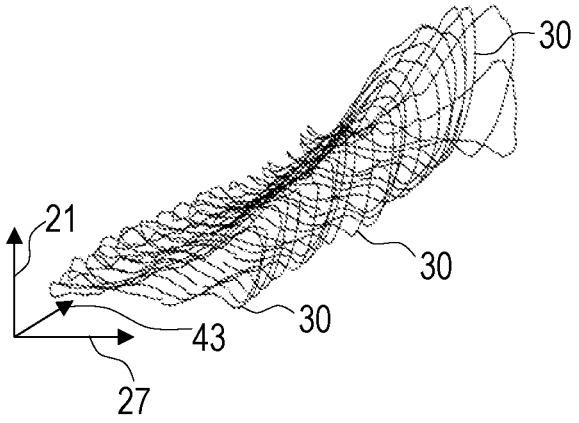
FIG. 6 a 3D-diagram of the force-path progressions for several vibration cycles with new ballast FIG. 7 a 3D-diagram of the force-path progressions for several vibration cycles with old ballast FIG. 8 section areas through the 3D-diagram according to FIG. 6
Figure 7:
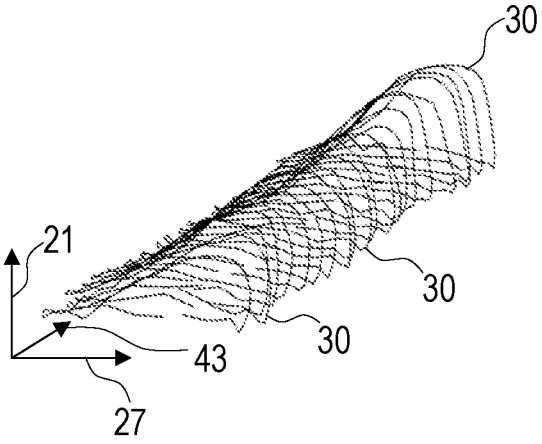

In an advantageous embodiment of the invention, all characteristic values 31-40 for each vibration cycle 29 are computed, and the progression is evaluated over the entire squeezing operation. In FIGS. 6 and 7, such progressions are shown in a spatial diagram. An x-axis and a y-axis correspond to the abscissa and the ordinate in FIGS. 3-5. On the third axis, a squeezing time 43 (sequence of the vibration cycles 29) is indicated. In FIG. 6, for example, it can be clearly seen that with new ballast 17 the maximum force 31 rises significantly with increasing squeezing time 43.

Figure 8:
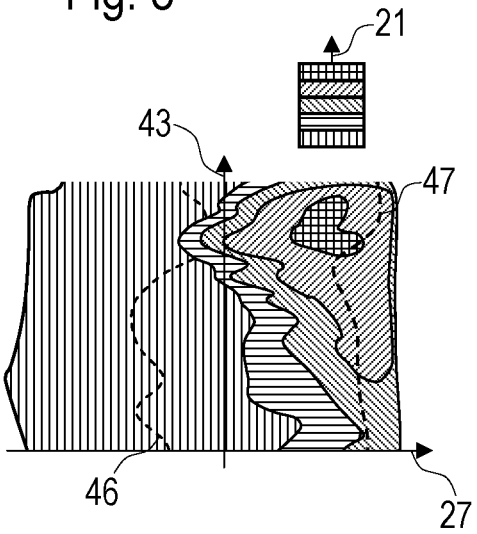
Figure 9:
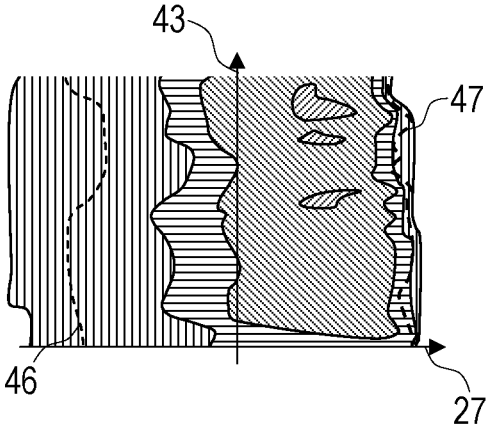
FIG. 9 section areas through the 3D-diagram according to FIG. 7
Figure 10:
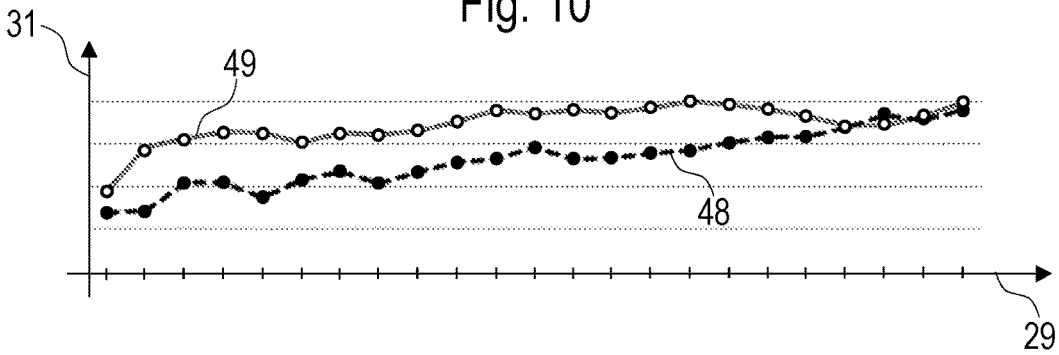
FIG. 10 progressions of the maximal force during two squeezing operations
Figure 11:
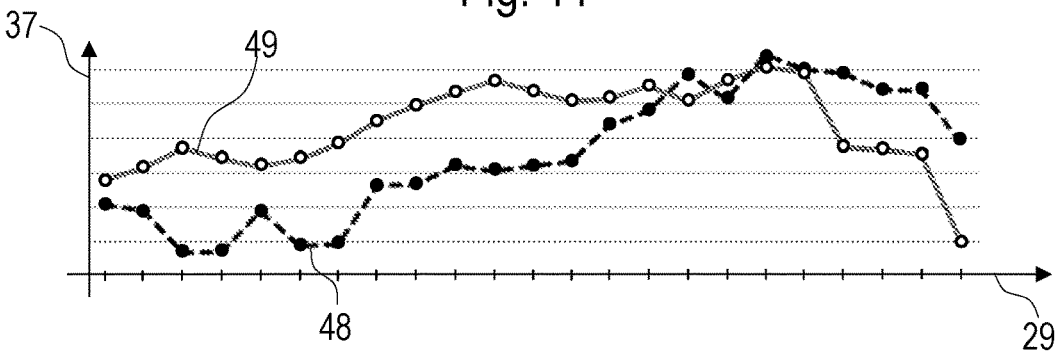
FIG. 11 progressions of the stress stiffness during two squeezing operations FIG. 12 progressions of the relief stiffness during two squeezing operations FIG. 13 progressions of the positions of the point of start of contact during two squeezing operations FIG. 14 progressions of the positions of the point of loss of contact during two squeezing operations FIG. 15 progression of the maximal force with new ballast FIG. 16 progression of the stress stiffness with new ballast FIG. 17 progression of the relief stiffness with new ballast FIG. 18 progression of the maximal force with old ballast FIG. 19 progression of the stress stiffness with old ballast FIG. 20 progression of the relief stiffness with old ballast
Figure 12:
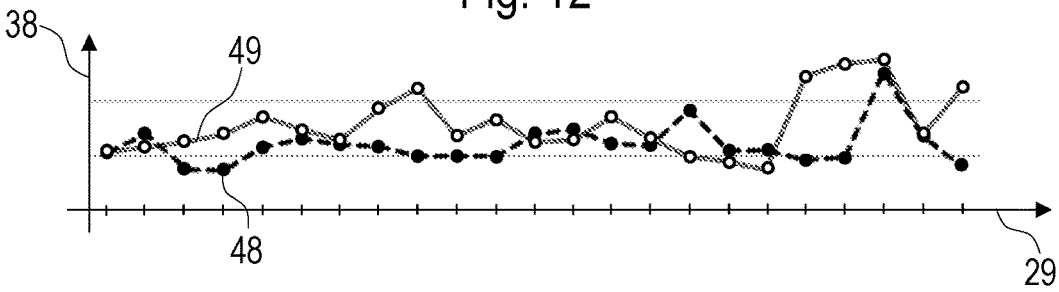
Figure 13:
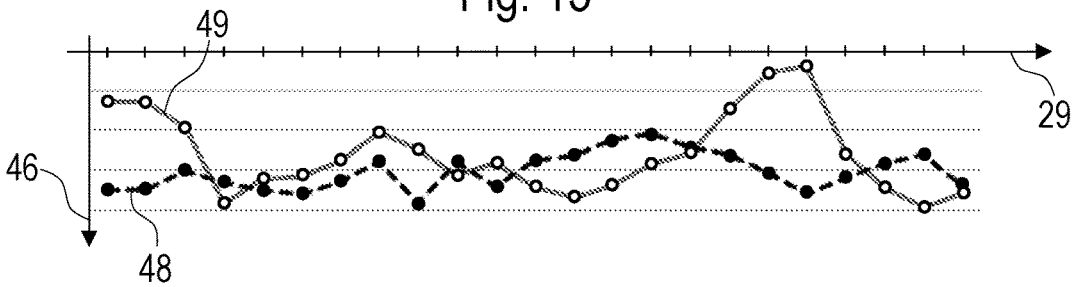
Figure 14:
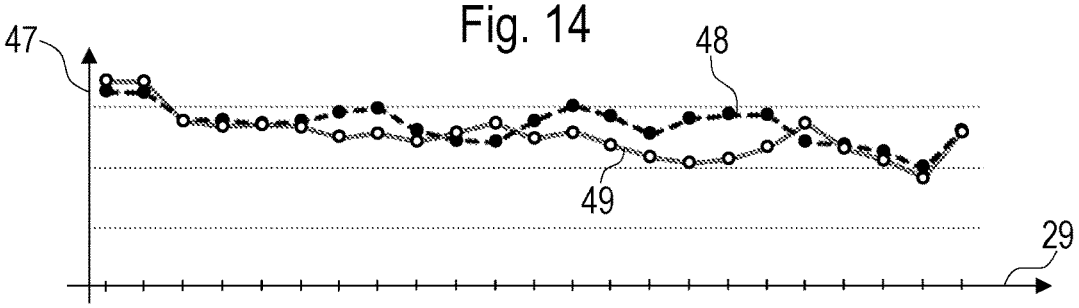
Figure 15:
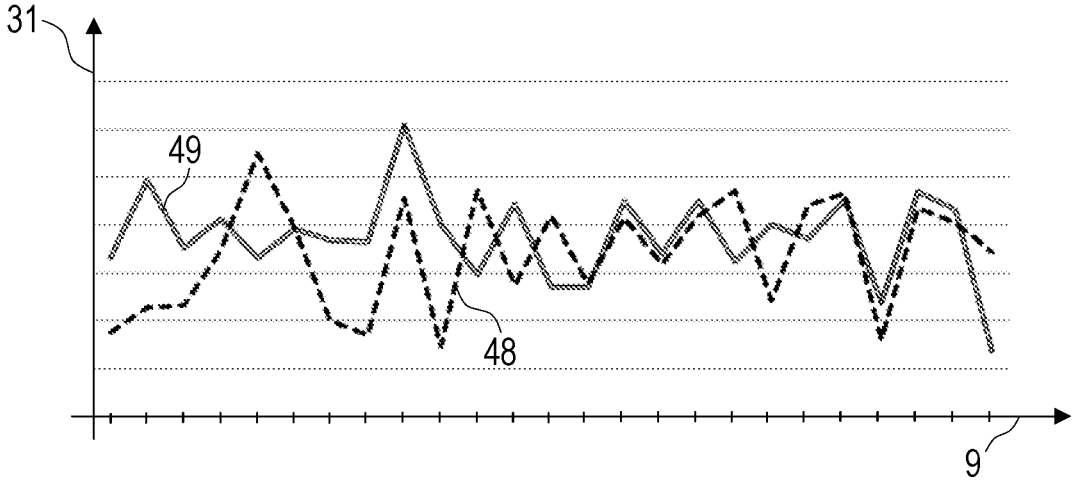
Figure 16:
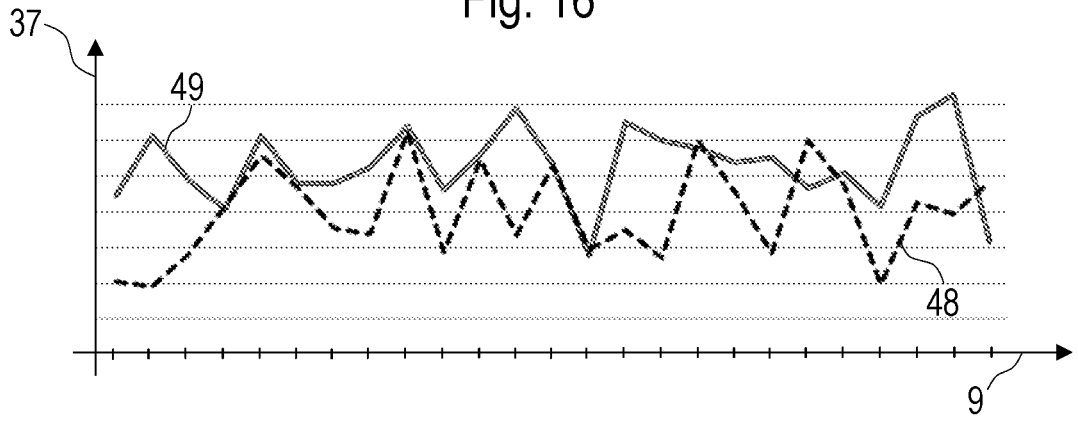
Figure 17:
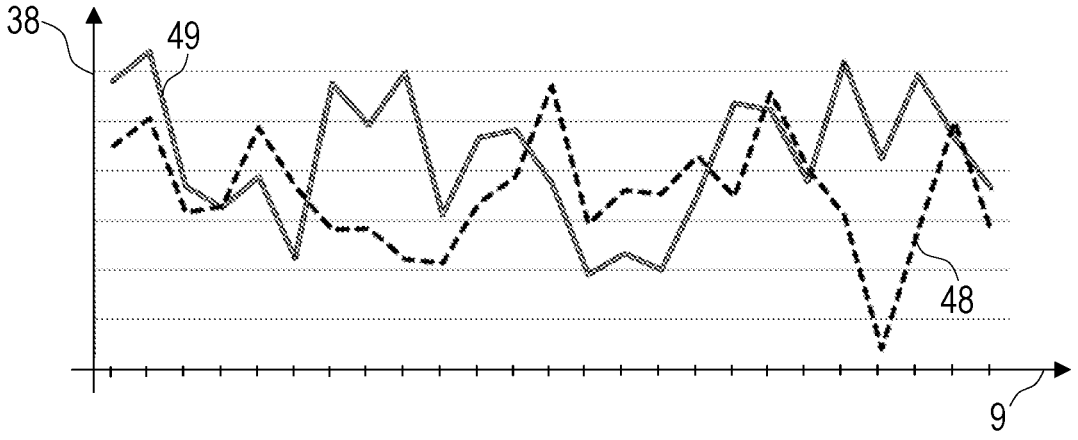
Figure 18:
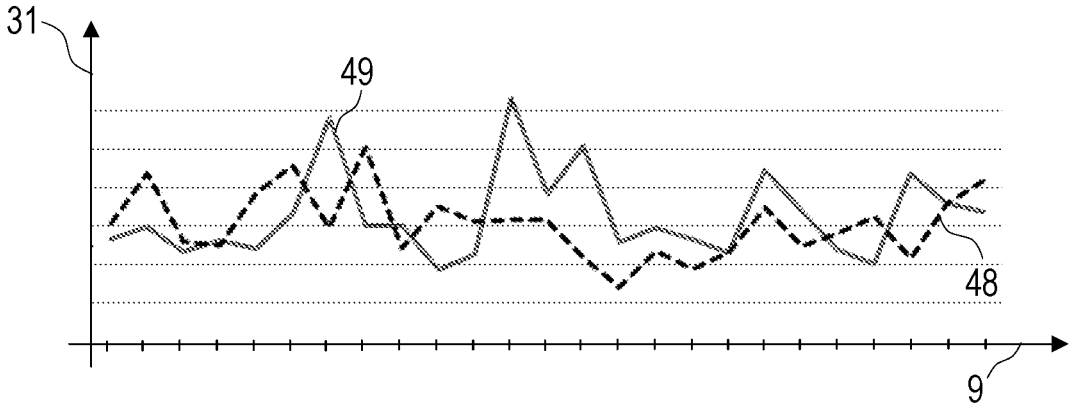
Figure 19:
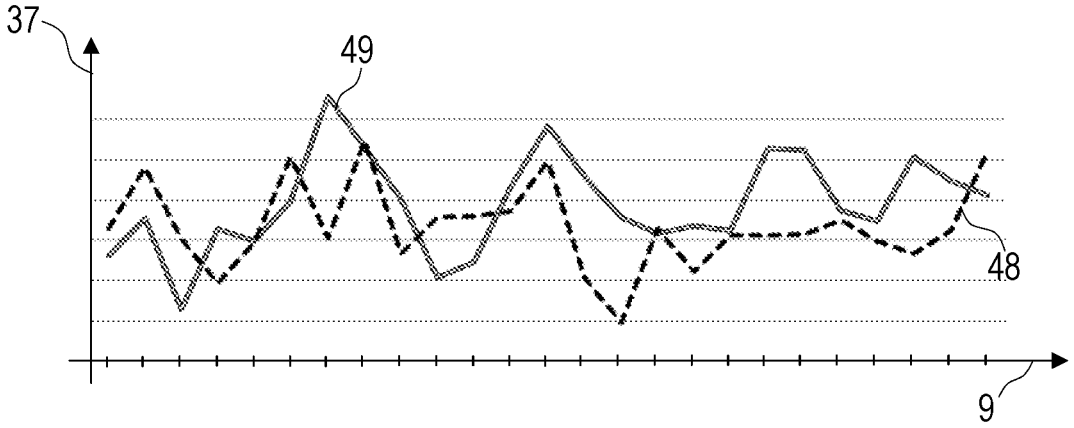
Figure 20:
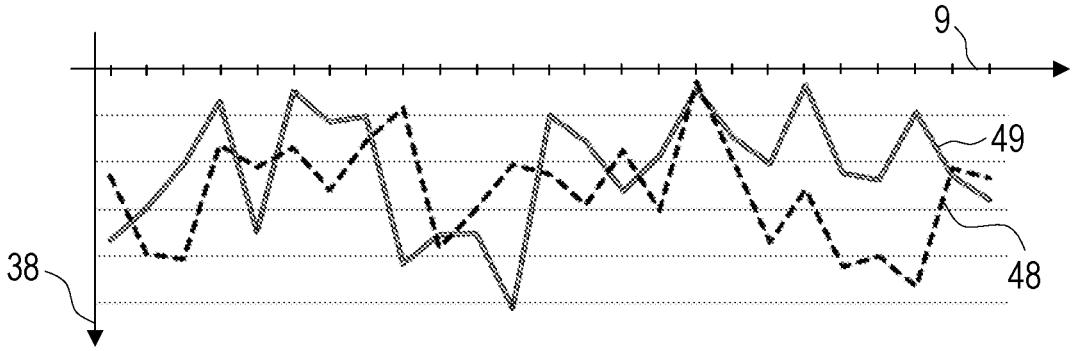

FIG. 8 shows the same measuring results as FIG. 6, and FIG. 9 shows the same measuring results as FIG. 7. However, here the force progression is represented as isolines 45 (isarithms) of equal force 21. The distance of these lines shows the inclination 37, 38 in the work diagram (for example, stress stiffness). Progression and size characterize the compaction operation in new ballast 17 (FIG. 8) and old ballast 17 (FIG. 9). Also drawn in here is a line of the positions 46 of the contact starting points 35 and a line of the positions 47 of the contact loss points 36. For the respectively constant contact force 21, different cross-hatching is used with increasing value. A corresponding legend is added to FIG. 8.

FIGS. 10-14 show characteristic value progressions for a sequence of several vibration cycles 29 with two tamping operations at a location 6 of the track 1. These are discrete progressions of those characteristic values (values of the respective characteristic FIGS. 31-40) which are recorded during the respective vibration cycle 29. The characteristic value progressions for a first squeezing operation 48 and a second squeezing operation 49 are shown together in the respective diagram and start in each case with the first vibration cycle 29 of the respective squeezing operation 48, 49. The comparison of the progressions allows conclusions as to the compaction of the ballast 17 and also serves as a decision-making criterion on how many tamping operations 9 per track location 6 are required. The difference between the first and the second squeezing operation 48, 49 is clearly evident and thus justifies the second operation 49.

In FIGS. 15-20, the characteristic value progressions for a sequence of several tamping operations 9 or sleeper positions at successive positions 6 along the track 1 are shown (spatial development). The respective diagram again shows the characteristic values of two squeezing operations 47, 48 for each tamping operation 9. These spatial progressions provide information about the homogeneity of the track 1, the ballast condition and the compaction result.

Particularly in tracks 1 with old ballast (FIGS. 18-20) and unsoled sleepers there are often substantial and small-scale differences between the support conditions of the individual sleepers 2. These circumstances also have an effect on the state of the ballast 17 and generally create heterogenous conditions. It is possible to react on this during the execution of the tamping operations 9 by prescribing changed parameters. However, the heterogeneity of the old track 1 remains existent. Therefore, the heterogeneity evaluated by means of the shown characteristic value progressions serves as a criterion for prescribing tamping intervals.

By way of an evaluation of the characteristic values 31-40 for a track section, it can therefore be estimated when a next treatment (tamping) of this track section will be required in order to maintain a satisfactory track position. With this, an indicator for a current categorization in the life cycle of the track 1 exists. With tamping intervals becoming increasingly shorter, the track 1 approaches the end of its service life, and rehabilitation measures have to be undertaken. The present method thus delivers characteristic values 31-40 which are also suited for comprehensive planning of the track maintenance.

The invention claimed is:

1. A method for compaction of a track ballast bed, the method comprising the following steps:

actuating two oppositely positioned tamping tools of a tamping unit with vibrations, lowering the tamping tools into the track ballast bed during a tamping operation and moving the tamping tools towards one another with a squeezing motion superimposed with vibration cycles of rapid opening and closing of the tamping tools with a small amplitude;

using sensors disposed at the tamping unit to record a progression of a horizontal contact force to ballast of the ballast bed acting upon at least one of the tamping tools over a vibration path covered by the tamping tool during an individual vibration cycle superimposed on the squeezing motion;

deriving an inclination of the progression during a relief phase of the tamping tool as at least one characteristic value from the recorded progression; and carrying out an evaluation of at least one of the tamping operation or a quality of the track ballast bed by using the at least one characteristic value.

2. The method according to claim 1, which further comprises using the characteristic value as a parameter for controlling the tamping unit.

3. The method according to claim 1, which further comprises deriving a maximal force acting on the tamping tool during the vibration cycle as a first characteristic value for evaluation of a ballast condition or a compaction condition of the ballast bed.

4. The method according to claim 3, which further comprises deriving a vibration amplitude occurring during the vibration cycle as a second characteristic value for evaluation of a compaction condition of the ballast bed.

5. The method according to claim 4, which further comprises determining a start of contact between the tamping tool and the ballast and a loss of contact between the tamping tool and the ballast for the vibration cycle to evaluate a ballast condition of the ballast bed, and deriving a third characteristic value from the evaluated ballast condition.

6. The method according to claim 5, which further comprises deriving an inclination of the progression during a stress phase of the tamping tool as a fourth characteristic value for evaluation of a load bearing capacity of the ballast bed.

7. The method according to claim 6, which further comprises deriving the inclination of the progression during the relief phase of the tamping tool as a fifth characteristic value for evaluation of a ballast condition of the ballast bed.

8. The method according to claim 7, which further comprises deriving a deformation work performed by the tamping tool from the recorded progression as a sixth characteristic value for determining a degree of utilization.

9. The method according to claim 8, which further comprises deriving an overall inclination of the progression as a seventh characteristic value for determining an overall stiffness of the ballast bed.

10. The method according to claim 9, which further comprises determining the overall inclination by linear regression of the recorded progression.

11. The method according to claim 1, which further comprises:

recording the progression of the force acting on the tamping tool over the path covered by the tamping tool for several vibration cycles of a tamping operation;

determining a characteristic value for each of the vibration cycles; and carrying out an evaluation procedure by using a characteristic value progression.

12. The method according to claim 1, which further comprises:

performing a plurality of squeezing operations at a track location;

determining a characteristic value for a vibration cycle or a characteristic value progression for several vibration cycles for evaluation of a compaction condition of the ballast bed for each squeezing operation; and performing a further squeezing operation upon non-attainment of a prescribed compaction condition.

13. The method according to claim 1, which further comprises:

determining a characteristic value for a vibration cycle or a characteristic value progression for several vibration cycles for each of a plurality of tamping operations at different locations along a track; and carrying out an evaluation of a spatial development of at least one of a compaction result or the quality of the ballast bed from the characteristic value or the characteristic value progression.

14. A device for compaction of a track ballast bed, the device comprising:

a tamping unit including two oppositely positioned tamping tools covering a path;

a squeezing drive for a squeezing motion of the tamping tools;

a vibration drive for generating vibrations cycles of rapid opening and closing of said tamping tools with a small amplitude superimposed on the squeezing motion;

pivot arms each coupling a respective one of said tamping tools to said squeezing drive and said vibration drive;

sensors disposed at least at one of said pivot arms or said tamping tool associated with said one of said pivot arms for recording a progression of a horizontal contact force to ballast of the ballast bed acting on said tamping tools over a vibration path covered by said tamping tools during an individual vibration cycle superimposed on the squeezing motion; and an evaluation device receiving measuring signals from said sensors, said evaluation device being configured for determining an inclination of the progression during a relief phase of the tamping tool as a characteristic value derived from the progression.

15. The device according to claim 14, which further comprises a tamping tool mount, and at least one force-measuring sensor disposed in said tamping tool mount.

* * * * *